US006266963B1

(12) United States Patent
Rudick

(10) Patent No.: US 6,266,963 B1
(45) Date of Patent: Jul. 31, 2001

(54) APPARATUS USING STIRLING COOLER SYSTEM AND METHODS OF USE

(75) Inventor: Arthur G. Rudick, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/412,687

(22) Filed: Oct. 5, 1999

(51) Int. Cl.[7] ..... F25B 9/02
(52) U.S. Cl. ..... 62/6; 62/285; 62/288
(58) Field of Search ..... 62/6, 55.5, 285, 62/288

(56) References Cited

U.S. PATENT DOCUMENTS

| | | | | |
|---|---|---|---|---|
| 2,470,547 | | 5/1949 | Childers | 62/103 |
| 4,259,844 | | 4/1981 | Sarcia et al. | 62/6 |
| 4,882,911 | * | 11/1989 | Immel | 62/288 |
| 4,922,722 | | 5/1990 | Kazumoto et al. . | |
| 4,941,527 | | 7/1990 | Toth et al. . | |
| 5,076,351 | | 12/1991 | Munekawa et al. . | |
| 5,142,872 | | 9/1992 | Tipton | 62/6 |
| 5,228,299 | * | 7/1993 | Harrington et al. | 65/55.5 |
| 5,309,986 | | 5/1994 | Itoh . | |
| 5,341,653 | * | 8/1994 | Tippmann et al. | 62/288 |

(List continued on next page.)

FOREIGN PATENT DOCUMENTS

| | | |
|---|---|---|
| 233-266 | 7/1944 | (CH) . |
| 0-935 063 | 8/1999 | (EP) . |
| 2-609-789 | 7/1988 | (FR) . |
| 64-36468 | 2/1989 | (JP) . |
| 2-217758 | 8/1990 | (JP) . |
| 7-180921 | 7/1995 | (JP) . |
| 98/34076 | 8/1998 | (JP) . |

OTHER PUBLICATIONS

Lyn Bowman, "A Technical Introduction to Free–Piston Stirling Cycle Machines: Engines, Coolers, and Heat Pumps," May 1993, pp. 1–7.
B.D. Mennink et al., "Development of an Improved Stirling Cooler for Vacuum Super Insulated Fridges with Thermal Store and Phtovoltaic Power Source for Industrialized and Developing Countries," May 10–13, 1994, pp. 1–9.
D.M. Berchowitz et al., "Recent Advances in Stirling Cycle Refrigeration," Aug. 20–25, 1995, 8 pages.
Kelly McDonald et al., "Stirling Refrigerator for Space Shuttle Experiments," Aug. 7–11, 1994; 6 pages.
Sunpower, Inc., "Introduction to Sunpower, Stirling Machines and Free–Piston Technology," Dec. 1995, pp. 1–4.
D.M. Berchowitz et al., "Test Results for Stirling Cycle Cooled Domestic Refrigerators," Sep. 3–6, 1996, 9 pages.
Royal Vendors, Inc., "G–III All Purpose Vendor Operation and Service Manual," Sep. 1996, pp. 1–67.
D.M. Berchowitz et al., "Stirling Coolers for Solar Refrigerators," 10 pages.

(List continued on next page.)

*Primary Examiner*—Ronald Capossela
(74) *Attorney, Agent, or Firm*—Sutherland, Asbill, Brennan, LLP

(57) ABSTRACT

There is disclosed a novel apparatus for use as a beverage container glass door merchandiser. The apparatus includes an insulated enclosure, the enclosure having an outside and an inside and at least partially defining a drain from the inside to the outside. A Stirling cooler has a hot portion and a cold portion. A heat-conducting member is disposed inside the enclosure and is connected in heat exchange relationship to the cold portion of the Stirling cooler. The heat-conducting member is also operatively associated with the drain such that condensation on the heat-conducting member can flow out of the enclosure through the drain. A method of cooling an insulated enclosure is also disclosed.

14 Claims, 4 Drawing Sheets

U.S. PATENT DOCUMENTS

| | | | | |
|---|---|---|---|---|
| 5,438,848 | | 8/1995 | Kim et al. . | |
| 5,496,153 | | 3/1996 | Redlich . | |
| 5,525,845 | | 6/1996 | Beale et al. . | |
| 5,537,820 | | 7/1996 | Beale et al. . | |
| 5,542,257 | * | 8/1996 | Klosson et al. | 62/55.5 |
| 5,596,875 | | 1/1997 | Berry et al. . | |
| 5,638,684 | | 6/1997 | Siegel et al. . | |
| 5,642,622 | | 7/1997 | Berchowitz et al. . | |
| 5,647,217 | | 7/1997 | Penswick et al. . | |
| 5,678,409 | | 10/1997 | Price . | |

OTHER PUBLICATIONS

Michael K. Ewert et al., "Experimental Evaluation of a Solar PV Refrigerator with Thermoelectric, Stirling, and Vapor Compression Heat Pumps," 7 pages.

D.M. Berchowitz Ph.D., "Maximized Performance of Stirling Cycle Refrigerators," 8 pages.

David Bergeron, "Heat Pump Technology Recommendation for a Terrestrial Battery–Free Solar Refrigerator," Sep. 1998, pp. 1–25.

Abstract of Japanese Publication No. 02302563 (Toshiba Corp.) Dec. 14, 1990.

Abstract of Japanese Publication No. 03036468 (Toshiba Corp.) Feb. 18, 1991.

Abstract of Japanese Publication No. 03294753 (Toshiba Corp.) Dec. 25, 1991.

Abstract of Japanese Publication No. 04217758 (Toshiba Corp.) Aug. 7, 1992.

Abstract of Japanese Publication No. 05203273 (Toshiba Corp.) Aug. 10, 1993.

Abstract of Japanese Publication No. 05306846 (Toshiba Corp.) Nov. 19, 1993.

Abstract of Japanese Publication No. 07180921 (Toshiba Corp.) Jul. 18, 1995.

Abstract of Japanese Publication No. 08005179 (Toshiba Corp.) Jan. 12, 1996.

Abstract of Japanese Publication No. 08100958 (Toshiba Corp.) Apr. 16, 1996.

Abstract of Japanese Publication No. 08247563 (Toshiba Corp.) Sep. 27, 1996.

* cited by examiner

APPARATUS USING STIRLING COOLER SYSTEM AND METHODS OF USE

FIELD OF INVENTION

The present invention relates generally to refrigeration systems, and, more specifically, to refrigeration systems that use a Stirling cooler as the mechanism for removing heat from a desired space. More particularly the present invention relates to glass door merchandisers for vending and for chilling beverage containers and the contents thereof.

BACKGROUND OF THE INVENTION

Refrigeration systems are prevalent in our everyday life. In the beverage industry, refrigeration systems are found in vending machines, glass door merchandisers ("GDMs") and dispensers. In the past, these units have kept beverages or containers containing a beverage cold using conventional vapor compression (Rankine cycle) refrigeration apparatus. In this cycle the refrigerant in the vapor phase is compressed in a compressor, causing an increase in temperature. The hot, high pressure refrigerant is then circulated through a heat exchanger, called a condenser, where it is cooled by heat transfer to the surrounding environment. As a result of the heat transfer to the environment, the refrigerant condenses from a gas to a liquid. After leaving the condenser, the refrigerant passes through a throttling device where the pressure and temperature both are reduced. The cold refrigerant leaves the throttling device and enters a second heat exchanger, called an evaporator, located in the refrigerated space. Heat transfer in the evaporator causes the refrigerant to evaporate or change from a saturated mixture of liquid and vapor into a superheated vapor. The vapor leaving the evaporator is then drawn back into the compressor, and the cycle is repeated.

Stirling coolers have been known for decades. Briefly, a Stirling cycle cooler compresses and expands a gas (typically helium) to produce cooling. This gas shuttles back and forth through a regenerator bed to develop much larger temperature differentials than the simple compression and expansion process affords. A Stirling cooler uses a displacer to force the gas back and forth through the regenerator bed and a piston to compress and expand the gas. The regenerator bed is a porous element with a large thermal inertia. During operation, the regenerator bed develops a temperature gradient. One end of the device becomes hot and the other end becomes cold. David Bergeron, *Heat Pump Technology Recommendation for a Terrestrial Battery-Free Solar Refrigerator*, September 1998. Patents relating to Stirling coolers include U.S. Pat. Nos. 5,678,409; 5,647,217; 5,638,684; 5,596,875 and 4,922,722 (all incorporated herein by reference).

Stirling coolers are desirable because they are nonpolluting, are efficient and have very few moving parts. The use of Stirling coolers has been proposed for conventional refrigerators. See U.S. Pat. No. 5,438,848 (incorporated herein by reference). However, it has been recognized that the integration of free-piston Stirling coolers into conventional refrigerated cabinets requires different techniques than conventional compressor systems. D. M. Berchowitz et al., Test Results for Stirling Cycle Cooler Domestic Refrigerators, Second International Conference. To date, the use of Stirling coolers in beverage vending machines, GDMs and dispensers is not known.

Therefore, a need exists for adapting Stirling cooler technology to conventional beverage vending machines, GDMs, dispensers and the like.

SUMMARY OF THE INVENTION

The present invention satisfies the above-described needs by providing novel applications of Stirling cooler technology to the beverage industry. A novel apparatus in accordance with the present invention comprises an insulated enclosure having an outside and an inside and at least partially defining a drain from the inside to the outside. A Stirling cooler is disposed outside the enclosure. The Stirling cooler has a hot portion and a cold portion. A heat-conducting member is disposed inside the enclosure and is connected in heat exchange relationship to the cold portion of the Stirling cooler. The heat-conducting member is operatively associated with the drain such that condensation on the heat-conducting member can flow out of the enclosure through the drain.

An alternate embodiment of the present invention comprises a method comprising cooling a heat-conducting member disposed inside an insulated enclosure. The heat-conducting member is associated in heat conducting relationship with a cold portion of a Stirling cooler. A bottom portion of the insulated enclosure at least partially defines a drain passage. The bottom portion is shaped such that fluid that falls on the bottom portion is directed to the drain passage. Fluid that flows through the drain passage is collected in a fluid collector outside the insulated enclosure. Air is moved past the fluid collector to promote evaporation of fluid therefrom.

Accordingly, it is an object of the present invention to provide improved refrigerated apparatus used in the beverage industry.

Another object of the present invention is to provide an improved glass door merchandiser.

Another object is to provide a system for easily mounting a Stirling cooler to a glass door merchandiser, so that it can be easily removed for service or repair.

A further object of the present invention is to provide a system for removing condensation from a glass door merchandiser cooled by a Stirling cooler.

These and other objects, features and advantages of the present invention will become apparent after a review of the following detailed description of the disclosed embodiments and the appended drawing and claims.

DESCRIPTION OF THE DISCLOSED EMBODIMENTS

Figure 1:
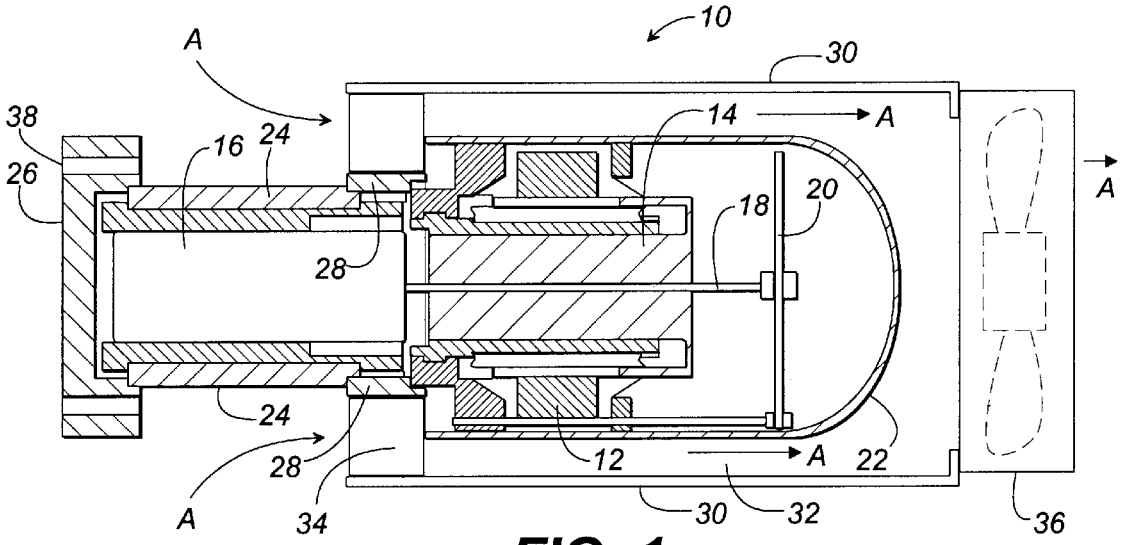
FIG. 1 is a cross-sectional view of a free-piston Stirling cooler useful in the present invention.
Figure 2:
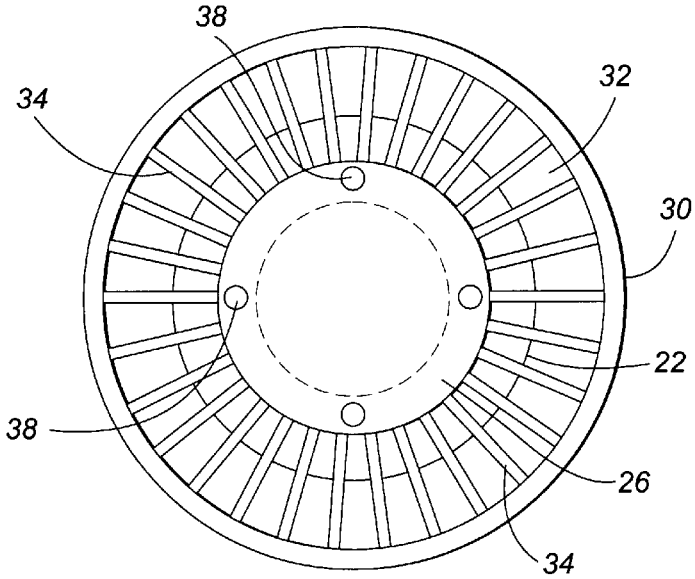
FIG. 2 is an end view of the Stirling cooler shown in FIG. 1.

The present invention utilizes a Stirling cooler. Stirling coolers are well known to those skilled in the art. Stirling coolers useful in the present invention are commercially available from Sunpower, Inc. of Athens, Ohio. Other Stirling coolers useful in the present invention are shown in U.S. Pat. Nos. 5,678,409; 5,647,217; 5,638,684; 5,596,875; 5,438,848 and 4,922,722 the disclosures of which are all incorporated herein by reference. A particularly useful type of Stirling cooler is the free-piston Stirling cooler. A free piston Stirling cooler useful in the present invention is available from Global Cooling With reference to the drawing in which like numbers indicate like elements throughout the several views, it can be seen that there is a free-piston Stirling cooler 10 (FIG. 1) comprising a linear electric motor 12, a free piston 14, a displacer 16, a displacer rod 18, a displacer spring 20, an inner casing 22, a regenerator 24, an acceptor or cold portion 26 and a rejector or hot portion 28. The function of these elements is well known in the art, and, therefore, will not be explained further here.

The Stirling cooler 10 also comprises a cylindrical outer casing 30 spaced from the inner casing 22 and defining an annular space 32 therebetween. The outer casing 30 is attached to the hot portion 28 of the Stirling cooler 10 by a plurality of heat-conducting fins 34 that extend radially outwardly from the hot portion to the outer casing. The fins 34 are made for a heat conducting material, such as aluminum. Attached to the end of the outer casing 30 opposite the fins 34 is an electric fan 36. The fan 36 is designed so that when it is operated air will flow into the Stirling cooler 10 trough the end of the outer casing 30 between the fins 34, through the space 32 and out of the opposite end of the outer casing in the direction as shown by the arrows at "A."

The cold portion 26 of the Stirling cooler 10 is greater in diameter than the regenerator 24. Four threaded holes 38 for receiving threaded bolts are provided in the cold portion. The threaded holes 38 provide a means for mounting the Stirling cooler 10 to apparatus as will be discussed further below.

Figure 3:
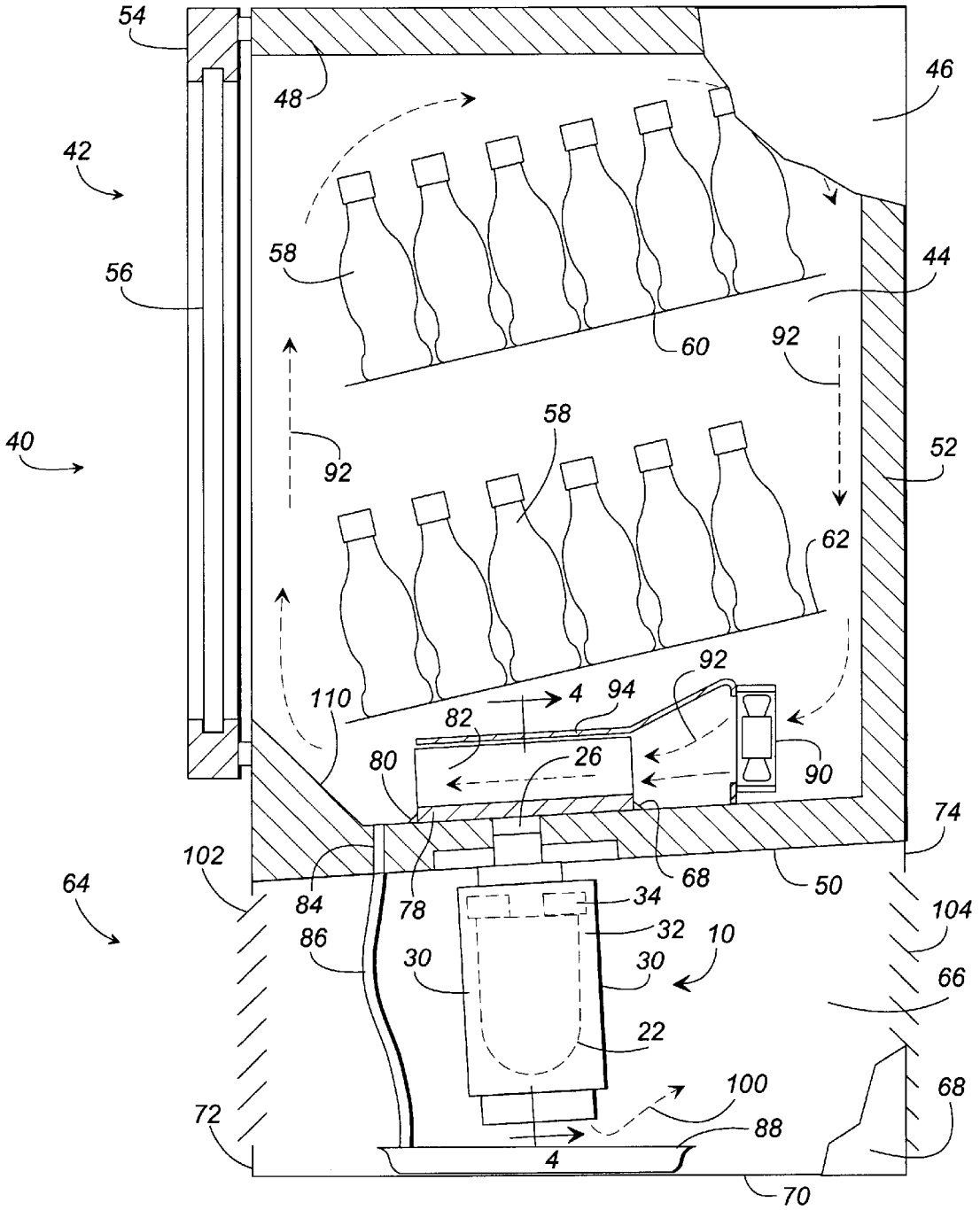
FIG. 3 is a side cross-sectional, schematic, partially broken away view of a disclosed embodiment of a glass door merchandiser in accordance with the present invention.

With reference to FIG. 3, there is shown a beverage container glass door merchandiser or GDM 40. The upper portion 42 of the GDM 40 comprises an insulated enclosure including insulated side walls 44, 46, insulated top and bottom walls 48, 50, respectively, and an insulated back wall 52. The GDM 40 also includes an openable front door 54 which typically includes a pane of glass 56 so that the contents of the GDM can be viewed from the outside. The walls 44, 46, 48, 50, 52 and the door 54 define an insulated chamber or enclosure in which a plurality of beverage containers 58 can be stored on wire shelves 60, 62 mounted inside the enclosure.

The lower portion 64 of the GDM 40 comprises an uninsulated enclosure including side walls 66, 68, bottom wall 70 and front and back walls 72, 74, respectively. The walls 66, 68, 70, 72, 74 define an uninsulated chamber or enclosure that functions as a base for the insulated enclosure and as a mechanical enclosure for the Stirling cooler 10 and associated parts and equipment.

Disposed within the uninsulated enclosure is the Stirling cooler 10. Although the present invention is illustrated as using a single Stirling cooler, it is specifically contemplated that more than one Stirling cooler can be used.

The bottom wall 50 of the insulated enclosure defines a hole 76 (FIG. 4) through which the cold portion 26 of the Stirling cooler 10 extends. Disposed above the hole 76 is a rectangular plate 78 made from a heat-conducting material, such as aluminum. The cold portion 26 of the Stirling cooler 10 contacts the heat-conducting plate 78 so that heat can flow from the plate to the cold portion of the Stirling cooler. At the juncture of the plate 78 and the bottom wall 50; i.e., around the periphery of the plate, is a waterproof sealant, such as a bead of silicone 80 (FIG. 3). The silicone 80 prevents fluids, such as condensed water vapor, from getting under the plate 78. The plate 78 is attached to the bottom wall 50 by bolts (not shown).

Figure 4:
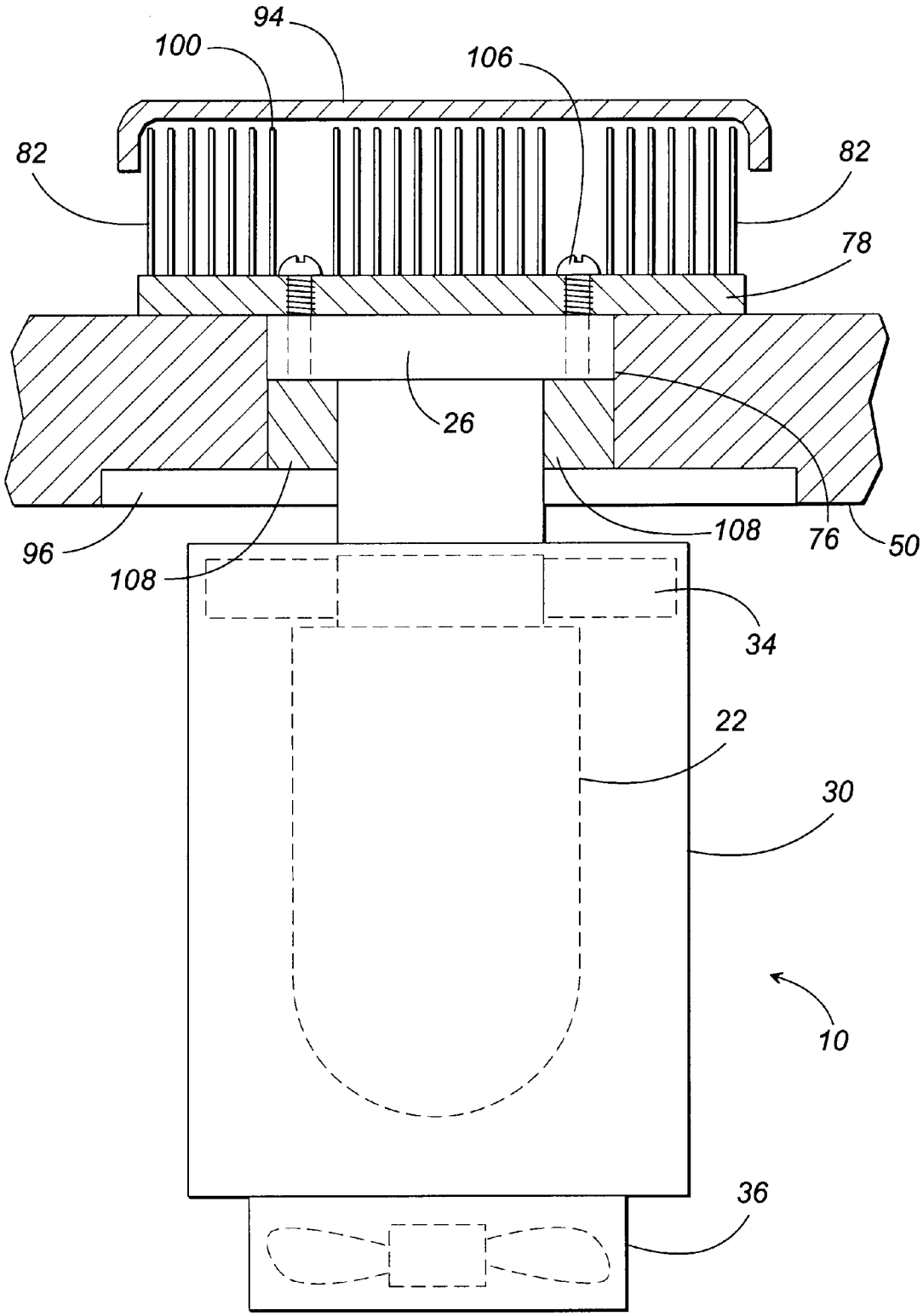
FIG. 4 is a partial detail cross-sectional view taken along the line 4—4 of the lower portion of the glass door merchandiser shown in FIG. 3.

Attached to the plate 78 and extending upwardly therefrom are a plurality of rectangular, heat-conducting fins 82. The fins 82 are made from a heat conducting material, such as aluminum. The fins 82 are equally spaced from and generally parallel to each other so that air can freely flow between adjacent plates (FIG. 4). The fins 82 are attached to the plate 78 such that heat can flow from the fins to the plate.

The bottom wall 50 is disposed at an angle whereby the front of the bottom wall is slightly lower than the rear of the bottom wall so that fluids, such as water, that fall on the bottom wall will run down the bottom wall under the influence of gravity. At its lowest point, the bottom wall 50 defines a drain passage 84 which extends from the inside of the insulated enclosure to the outside of the insulated enclosure (i.e., to the inside of the uninsulated enclosure). The drain passage 84 permits fluid, such as water, that runs down the bottom wall 50 to flow through the passage thereby removing the water from the insulated enclosure.

Attached to the drain passage 84 is a pipe or tube 86 which extends downwardly therefrom. Disposed on the bottom 70 of the uninsulated enclosure below the drain passage 84 is a fluid container, such as a pan 88. Fluid that flows down the drain passage 84 is directed through the tube 86 into the pan 88 where the fluid is collected.

Attached to the bottom wall 50 adjacent the rear of the insulated enclosure is a fan 90. The fan 90 is oriented so that it will blow air in the direction indicated by the arrows at 92. Attached to the fan 90 is a shroud 94 that extends outwardly from the fan toward and over the fins 82. The shroud 94 assists in directing air blown by the fan 90 through the fins 82.

As previously indicated, the Stirling cooler 10 is disposed in the uninsulated enclosure below the bottom wall 50 of the insulated enclosure. The portion of the bottom wall 50 adjacent the Stirling cooler 10 defines a recessed portion 96. The recessed portion 96 provides more room for air to flow between the bottom wall 50 and the outer casing 30 of the Stirling cooler 10 thereby permitting air to more freely flow into the annular space 32 through the fins 34 and out the fan 36.

The fan 36 is oriented so that it blows air toward the pan 88, such as indicated by the arrow at 100. The air flowing between the fins 34 of the Stirling cooler 10 is heated by the heat transferred from the hot portion 28 of the Stirling cooler to the fins and hence to the air surrounding the fins. This warmed air is blown by the fan 36 toward the pan 88. Evaporation of fluid in the pan 88 is thus promoted by the blowing of warm air from the fan 36. Louvers 102, 104 are provided in the front and rear walls 72, 74, respectively, so as to permit air to freely flow through the uninsulated enclosure.

The Stirling cooler 10 is attached to the GDM 40 by four threaded bolts 106 that extend through holes in the plate 78 aligned with the four threaded holes 38 in the cold portion 26 of the Stirling cooler 10. The bolts 106 can be screwed into the holes 38 thereby to attach the Stirling cooler 10 to the GDM 40. A torroidal piece of compliant foam insulation 108 is press fit into the annular space between the cylindrical hole 76 in the bottom wall 50 and the cylindrical shaft of the regenerator 24. The insulation 108 prevents or reduces the amount of heat that is transferred to the cold portion 26 of the Stirling cooler 10 from the uninsulated enclosure.

Operation of the GDM 40 will now be considered. The door 54 is opened and beverage containers 58 are stacked on the shelves 60, 62. The shelves 60, 62 are preferably slanted so that gravity moves the next beverage container to a location adjacent the door when a container is removed from the shelf. Of course, level shelves can also be used in the present invention.

The fans 36, 90 and the Stirling cooler 10 are all operated by suitable electrical circuits (not shown). The fan 90 blows air across the fins 82 and generally circulates the air in the insulated enclosure in the direction shown by the arrows at 92. The bottom wall 50 includes a wedge-shaped deflector portion 110 adjacent the door 54 to assist in deflecting the air from the fan 90 upwardly in front of the door. Heat from the beverage containers 58 and the contents thereof is transferred to the moving air circulating in the insulated enclosure. When the fan 90 blows the air in the insulated enclosure across the fins 82, heat is transferred from the air to the fins. Heat in the fins 82 is then transferred to the plate 78 and hence to the cold portion 26 of the Stirling cooler 10. Operation of the Stirling cooler 10 transfers the heat from the cold portion 26 to the hot portion 28 where it is then transferred to the fins 34 contained within the outer casing 30 of the Stirling cooler 10 and hence to the air surrounding the fins.

Cooling of the air blown across the fins 82 by the fan 90 usually will result in condensation of the water vapor in the air onto the cold surface of the fins. When sufficient condensation forms on the fins 82, it will run down the fins onto the plate 78. Since the plate 78 is at an angle, the condensation will run off the plate onto the bottom wall 50. Since the bottom wall 50 is also at an angle, the condensation will seek the lowest point of the wall. Since the drain passage 84 is located at the lowest point of the bottom wall 50, the condensation will flow out of the insulated enclosure through the drain passage. Other condensation that may form on the inside walls of the insulated enclosure, on the beverage containers 58, on the wire racks 60, 62 or on the shroud 94 will similarly run onto the bottom wall 50 and hence through the drain passage 84.

The condensation that flows through the drain passage 84 will also flow through the tube 86 which directs the fluid into the pan 88. Fluid from the tube 86 collects in the pan 88. Air warmed by the hot portion 28 and fins 34 of the Stirling cooler 10 and flowing through the space 32 between the inner casing 22 and outer casing 30 is blown by the fan 36 toward the fluid in the pan 88 which promotes evaporation of the fluid from the pan. Air circulating through the louvers 102, 104 in the front and back walls 72, 74 carries the moisture laden air created by the evaporation of the water in the pan 88 out of the uninsulated enclosure to the surroundings of the GDM 40.

Figure 5:
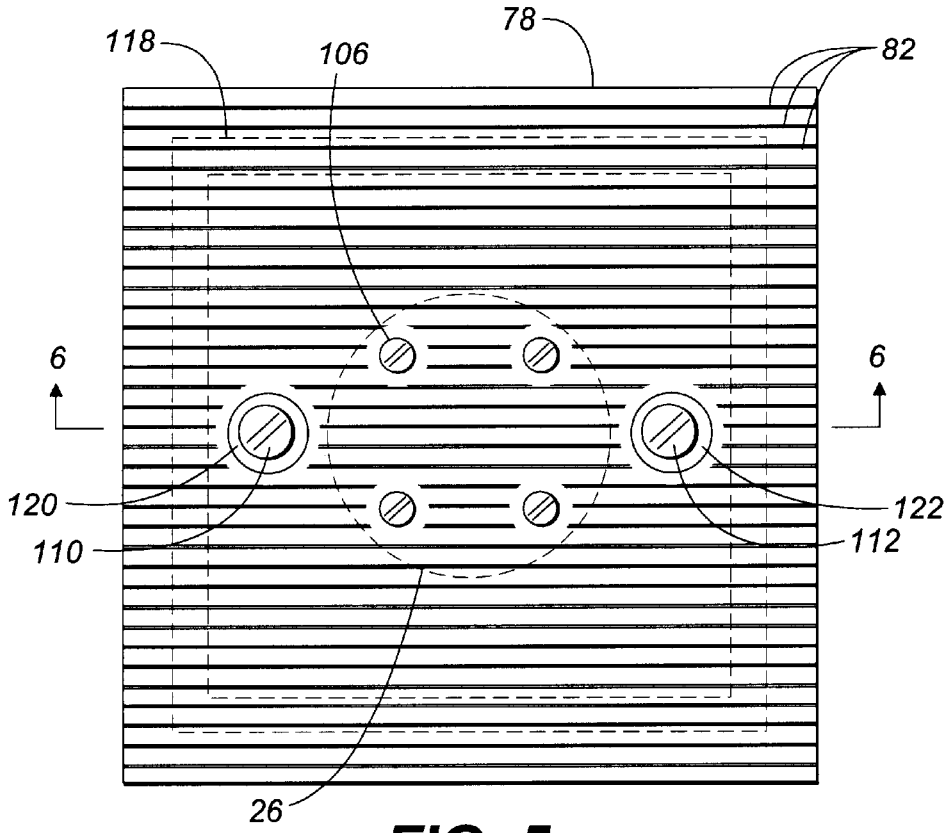
FIG. 5 is a detail top view of another disclosed embodiment of the heat exchange assembly mounted within the glass door merchandiser shown in FIG. 3, shown with the shroud removed for clarity.
Figure 6:
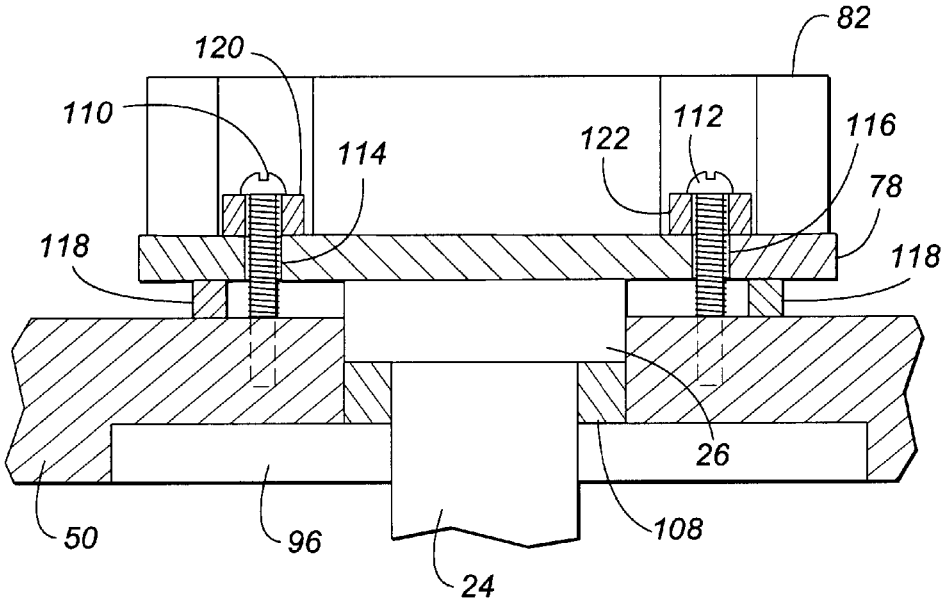
FIG. 6 is a detail cross-sectional view taken along the line 6—6 of the heat exchange assembly shown in FIG. 5, shown without the shroud for clarity.

With reference to FIGS. 5 and 6, it can be seen that there is shown an alternate disclosed embodiment of the heat exchanger mounted within the GDM40. As can best be seen in FIG. 6, the heat exchange base plate 78 includes a plurality of fins 82 attached thereto. The fins 82 are discontinuous in the region of screws 110, 112 and the four screws 106. The screws 110, 112 extend through holes 114, 116 through the plate 78 and attach the plate to the bottom wall 50 of the GDM 40. A rectangular gasket 118 is provided between the plate 78 and the bottom wall 50 of the GDM 40. The gasket 118 is made from a compliant elastomeric material, such as low durometer polyurethane. The gasket 118 also serves as a seal between the plate 78 and the bottom wall 50 of the GDM 40 so that the bead of silicone 80 is not necessary. A compliant elastomeric torroid-shaped washers 120, 122 is also provided for each of the screws 110, 112 and fits between the bottom of the head of each screw and the top surface of the plate 78. The gasket 118 and the washers 120, 122 provide insulation between the plate 78 and the bottom wall 50 of the GDM 40 and reduce the amount of vibration that is transferred from the Stirling cooler 10 to the plate 78 and then to the bottom wall 50. This reduced amount of vibration provides significantly quieter operation of the Stirling cooler 10.

When it is desired to remove the Stirling cooler 10 from the GDM 40 for repair or maintenance, the four screws 106 are removed. This permits the Stirling cooler 10 to be slid out of the hole 76 in the plate 78 and to be removed completely from the GDM 40. Repairs can then be made to the Stirling cooler 10 or a replacement Stirling cooler can be reinstalled in the GDM 40 by sliding the cold portion 26 back into the hole 76 and reinstalling the screws 106. The Stirling cooler 10 that was removed can then be repaired at a remote location.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. An apparatus comprising:

an insulated enclosure, said enclosure having an outside and an inside, said enclosure at least partially defining a drain from said inside to said outside;

a Stirling cooler having a hot portion and a cold portion;

said Stirling cooler further comprising a fan operatively associated with said Stirling cooler for moving air past said hot portion of said Stirling cooler;

a heat-conducting member disposed inside said enclosure, said heat-conducting member being connected in heat exchange relationship to said cold portion of said Stirling cooler, said heat-conducting member being operatively associated with said drain such that condensation on said heat-conducting member can flow out of said enclosure through said drain; and a fluid container disposed below said drain, said fluid container being operatively associated with said fan such that said fan promotes evaporation of fluid from said fluid container.

2. The apparatus of claim 1 further comprising a conduit operatively associated with said drain for channeling fluid from said drain to said fluid container.

3. The apparatus of claim 1 further comprising a second fan disposed inside said insulated enclosure and operative to move air past said heat-conducting member.

4. The apparatus of claim 1, wherein said heat conducting member comprises a plurality heat-conducting plates spaced from each other and in heat conducting relationship with each other.

5. The apparatus of claim 4, wherein said heat-conducting plates are attached to a heat-conducting block disposed inside said enclosure.

6. The apparatus of claim 5, wherein said cold portion of said Stirling cooler is connected to said heat-conducting block.

7. The apparatus of claim 1, wherein said heat conducting member and said cold portion of said Stirling cooler are connected in a conductive heat exchange relationship.

8. The apparatus of claim 1, wherein said Stirling cooler comprises a free piston Stirling cooler.

9. The apparatus of claim 1, wherein said fan directs air flow onto the fluid in said fluid container.

10. An apparatus comprising:

an insulated enclosure comprising opposed insulated side walls, insulated top and bottom walls, an insulated back wall and an openable door at least partially defining a front wall, said bottom wall at least partially defining a drain passage, said bottom wall being shaped such that fluid that falls on said bottom wall is directed to said drain passage;

a fluid container disposed below said drain passage, said fluid container being operative to collect fluid that flows out of said drain passage;

a Stirling cooler having a hot portion and a cold portion;

a heat-conducting member disposed inside said enclosure, said heat-conducting member being connected in heat exchange relationship to said cold portion of said Stirling cooler, said heat conducting member being disposed such that condensation on said heat-conducting member will fall onto said bottom wall; and a fan operatively associated with said Stirling cooler for moving air past said hot portion of said Stirling cooler and towards said fluid container such that said fan promotes evaporation of fluid from said fluid container.

11. The apparatus of claim 10, further comprising a fan operatively associated with said heat-conducting member such that said fan moves air past said heat-conducting member.

12. The apparatus of claim 10, wherein said heat conducting member and said cold portion of said Stirling cooler are connected in a conductive heat exchange relationship.

13. The apparatus of claim 10, wherein said Stirling cooler comprises a free piston Stirling cooler.

14. The apparatus of claim 10, wherein said fan directs air flow onto the fluid in said fluid container.

* * * * *